US007681747B2

(12) United States Patent
Crowder

(10) Patent No.: US 7,681,747 B2
(45) Date of Patent: Mar. 23, 2010

(54) CRANE

(76) Inventor: Jeffrey Lee Crowder, Mallards Rest Priory Gardens St. Olaves, Great Yarmouth (GB) NR31 9TB ( * ) Notice: Subject to any disclaimer, the term of this patent is extended or adjusted under 35 U.S.C. 154(b) by 0 days.

(21) Appl. No.: 11/571,214

(22) PCT Filed: Jun. 28, 2005

(86) PCT No.: PCT/GB2005/002517

§ 371 (c)(1),
(2), (4) Date: Sep. 17, 2007

(87) PCT Pub. No.: WO2006/000808

PCT Pub. Date: Jan. 5, 2006

(65) Prior Publication Data

US 2008/0035594 A1 Feb. 14, 2008

(30) Foreign Application Priority Data

Jun. 29, 2004 (GB) ..... 0414476.2

(51) Int. Cl.
*B66C 23/22* (2006.01)

(52) U.S. Cl. ..... 212/179; 212/166; 212/263

(58) Field of Classification Search ..... 212/179, 212/166, 262–263
See application file for complete search history.

(56) References Cited

U.S. PATENT DOCUMENTS

| | | | | | |
|---|---|---|---|---|---|
| 22,052 | A | * | 11/1858 | Wood et al. | 212/255 |
| 168,372 | A | * | 10/1875 | Caswell et al | 212/239 |
| 845,143 | A | * | 2/1907 | Taylor | 212/179 |
| 998,134 | A | * | 7/1911 | Taylor | 212/179 |
| 1,583,442 | A | * | 5/1926 | Broadhead | 254/409 |
| 1,720,714 | A | * | 7/1929 | Bergesen, Sr. | 212/239 |
| 1,775,398 | A | * | 9/1930 | Kacena | 212/339 |
| 2,419,145 | A | | 4/1947 | Kersenbrock | |
| 2,744,637 | A | * | 5/1956 | Stewart | 212/281 |
| 3,391,906 | A | * | 7/1968 | Duerst | 254/269 |
| 3,974,995 | A | * | 8/1976 | Blonde | 249/19 |
| 4,560,074 | A | * | 12/1985 | Manning | 212/179 |

(Continued)

FOREIGN PATENT DOCUMENTS

| | | | |
|---|---|---|---|
| FR | 2 445 292 | * | 7/1980 |

(Continued)

OTHER PUBLICATIONS

International Search Report, European Patent Office, Sep. 5, 2005.

*Primary Examiner*—Thomas J. Brahan
(74) *Attorney, Agent, or Firm*—Bourque and Associates, PA

(57) ABSTRACT

A crane to be fitted in a window opening or the like, between two opposing surfaces, has a strut (14) which is first braced between the surfaces (20*a*, 20*b*), and a boom (13) which extends away from the strut. A winch (5) on the crane winds up a lifting cafe (12) which runs over a pulley (3) at the outer end of the boom (13). The top and bottom ends of the strut have end plates (15, 7) which are designed to hold the crane rigidly between the two surfaces, but without damaging any surface finish on either surface. The boom (13) can be swung about the axis of the strut (14) to bring the load carried by the crane in towards the position of the operator.

7 Claims, 9 Drawing Sheets

U.S. PATENT DOCUMENTS

| | | | | | |
|---|---|---|---|---|---|
| 4,750,691 | A | * | 6/1988 | Hollrock et al. | 244/137.1 |
| 5,147,013 | A | * | 9/1992 | Olson et al. | 182/231 |
| 5,316,265 | A | * | 5/1994 | Welch et al. | 254/362 |
| 5,617,963 | A | * | 4/1997 | Baziuk et al. | 212/179 |
| 5,934,038 | A | * | 8/1999 | Clausen | 52/745.2 |
| 6,499,610 | B2 | * | 12/2002 | Spitsbergen | 212/179 |
| 7,044,313 | B2 | * | 5/2006 | Haliburda, III | 212/179 |

FOREIGN PATENT DOCUMENTS

| | | | | |
|---|---|---|---|---|
| GB | 2209786 | | | 5/1989 |
| JP | 2000-335884 | A | * | 12/2000 |
| RU | 1689292 | A2 | * | 11/1996 |
| SU | 1756504 | A2 | * | 8/1992 |
| WO | 88/01670 | | * | 3/1988 |

* cited by examiner

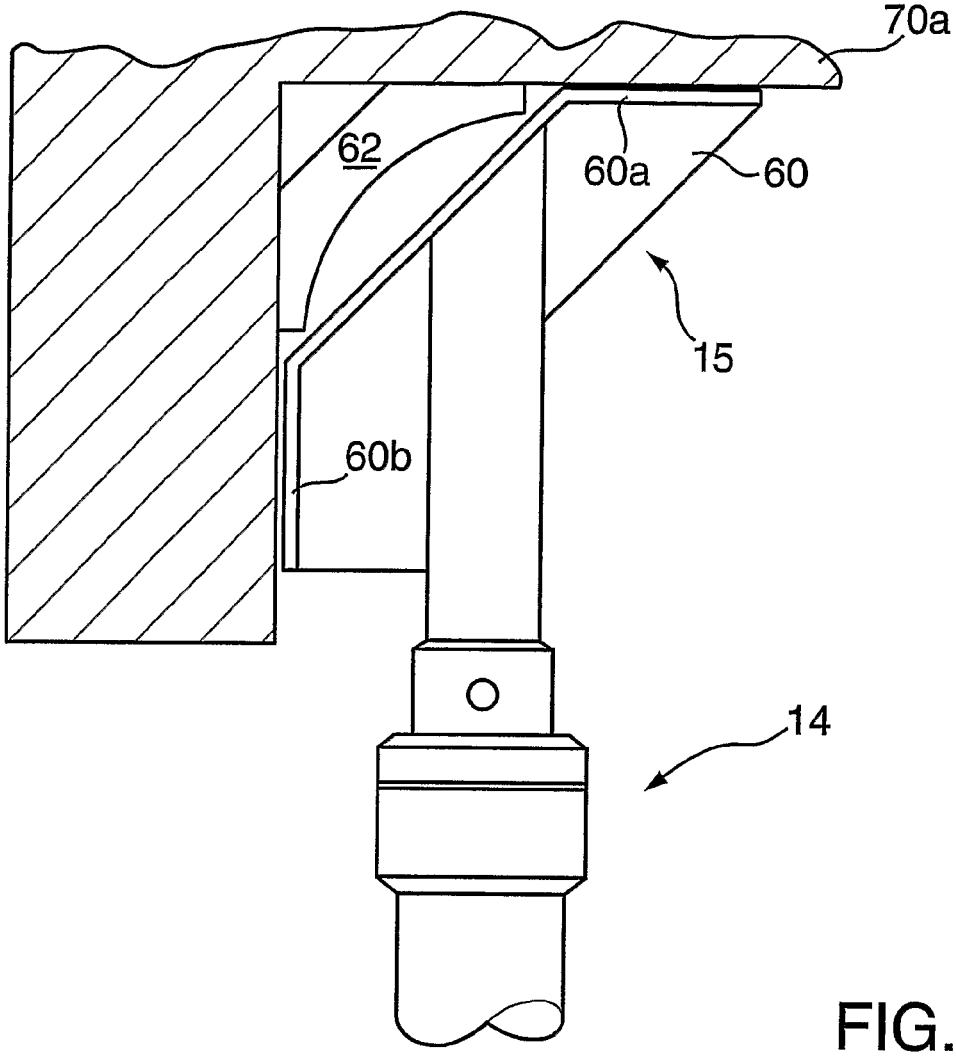
FIG. 5
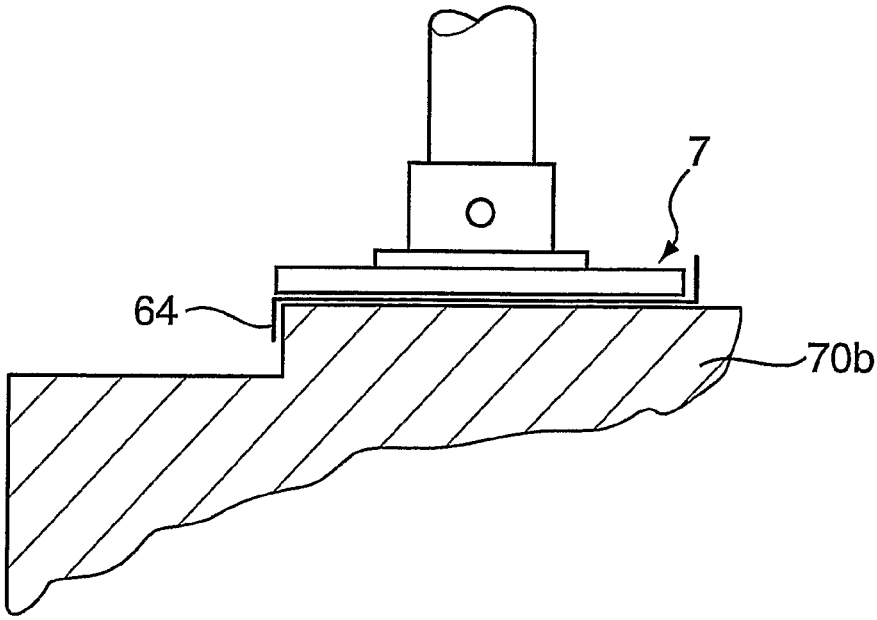

CRANE

BACKGROUND a. Field of the Invention

The present invention relates to a crane. More particularly, it concerns a crane suitable for assisting the installation of windows in a building.

b. Related Art

Windows are often fitted to a building by carrying them up a ladder, and then installing them whilst standing on the ladder. However, windows are heavy and working with ladders in this way inevitably puts the installers at significant risk. Alternatively, scaffolding may be used, but this is time consuming and costly to construct.

SUMMARY OF THE INVENTION

According to a first aspect of the invention, there is provided a crane for use in raising windows into place in a window opening in a building, the crane comprising an adjustable length strut having a head plate at one end and a foot plate at the other end and a boom mounted on the strut, the head plate having two faces substantially at right angles to one another for engagement with two surfaces of an edge of a window opening in which the crane is to be used, and the foot plate having a toe edge extending rigidly at right angles to the axis of the strut.

A winch is preferably mounted on the crane, the winch having a drum for winding up a cable which passes over a pulley at the outboard end of the boom. The winch can be mounted on the boom or on the strut, or on another parts of the crane, but is preferably mounted on the boom.

The upper surfaces of the head plate and the lower surface of the foot plate preferably have engagement surfaces which will not mark the window opening, so that the crane can be used in a building without damaging any surfaces or decorative finishes which may have been applied. For example, the engagement surfaces can be provided with a rubber layer, which also helps to enhance friction between the plates and the surfaces of the window opening with which they are in contact.

The length of the strut can be adjusted so that the strut ends of the strut are in close contact with the top and bottom of a window opening. The strut can include a screw threaded member and a complementary threaded member engaged therewith, such that relative rotation of the two members varies the length of the strut. In a preferred configuration, the threaded member has an opening at one end which slidably receives an elongate member extending from the foot plate, and a pin is provided on the elongate member which extends through a slot in the threaded member, such that rotation of the complementary member about the screw threaded member urges it against the pin, which urges the engagement surfaces apart.

The length of the strut will depend on the distance between the surfaces against which the strut will be braced, and can be set, for example by the use of extension pieces, for specific applications.

The boom can preferably pivot about the axis of the strut through at least 90 degrees, so that a window supported on the crane can be lifted up the outside of a building with the boom projecting out at right angles to the plane of the window opening, and can then be manoeuvred into the window opening when the window is at the right height, by pivoting the boom into the plane of the window opening.

The crane may be configured so that in use the distal end of the boom is lower than the uppermost of the engagement surfaces. Thus the boom may be swung right into the opening in which the crane is mounted.

The length of the boom may be fixed, and the boom held at a predetermined angle in use which locates the distal end lower than the upper engagement surface. In another embodiment the angle of the boom may be adjusted to lower and raise the distal end as required. In a further embodiment, the length of the boom may be adjustable, by means of a telescopic boom section for example, which could also serve to vary the height of its distal end, enabling it to be brought within a window opening.

The boom can be pivoted at one end to the strut and, when in use, held at an angle to the strut by a flexible linkage between a distal end of the boom and an upper region of the strut. The boom can then be pivoted into a position where it is substantially parallel with the strut when it is not supporting a load. There may be a latch to hold the boom substantially parallel with the strut when it is not supporting a load.

According to a second aspect of the invention, there is provided a crane for use in raising windows into place in a window opening in a building, the crane comprising an adjustable length strut having a head plate at one end and a foot plate at the other end and a boom mounted on the strut, the strut being extendable to press the head and foot plates against opposing surfaces of a window opening, wherein the boom is pivoted at one end to a lower region of the strut and wherein the crane includes a winch and a hoisting cable wound on the winch, the hoisting cable extending from the winch, around a pulley on the strut, over a pulley at a distal end of the boom and to a load engagement point, such that when a load is fully hoisted to the distal end of the boom, further winding of the winch draws the boom towards the strut.

In this aspect of the invention, the winch is preferably mounted on the strut.

In this aspect also, a latch is preferably provided to latch the boom to the strut when the boom has been drawn fully towards the strut.

According to a third aspect of the invention, there is provided a crane for use in raising windows into place in a window opening in a building, the crane comprising an adjustable length strut having a head plate at one end and a foot plate at the other end such that the strut can be set in place in a window opening by extending the strut to engage the head and foot plates with opposing surfaces of a window opening, a boom mounted on the strut and a winch, wherein the boom has a pulley at its end remote from the strut, and a hoisting cable runs from the winch, over the pulley and to means which is to be attached to a window to be lifted into the opening, so that the window can be lifted by operating the winch from within the building.

In this aspect of the invention, the winch is preferably mounted on the boom.

The winch in the crane preferably has a ratchet mechanism which allows the winch drum to be rotated in only one direction to wind up the cable, the mechanism being able to be disengaged to allow the cable to be unwound. The crane can then be operated single handed by a single operator within the building. The winch will preferably be hand operated, but can also be motorised.

According to a fourth aspect of the invention, there is provided a method of installing a window in a window opening in a building using a crane, the crane comprising an extendable elongate strut, a boom mounted on the strut, a head plate at one end of the strut and a foot plate at the other end of the strut, the method comprising the steps of positioning the crane in the window opening so that the position in which the window is to be installed is not obstructed by either the head plate or the foot plate, extending the strut to bring the head plate and foot plate into contact with opposing surfaces of the window opening internally of the opening, and using a cable running over a pulley at the end of the boom to raise a window up to the height of the window opening so that the window can be located in its final position without removing the crane from the window opening.

When the window has been raised to the desired height, the boom can be pivoted about the axis of the strut to move the window into the window opening. The crane can remain in place, connected to the window, until the window is securely positioned in its final installation position. When pre-glazed windows are being installed, the crane can be attached to the window by suction pads attached to the window glass.

According to a fifth aspect of the invention, there is provided a crane comprising a strut, a boom mounted on the strut for pivotal movement about an axis perpendicular to the length of the strut, a winch, a hoisting cable and means for securing the strut to a fixed structure.

The securing means may comprise scaffold pole clamps to enable the strut to be clamped to a vertical scaffold pole. In this connection, the strut itself may be constructed from the same tubular material used for scaffold poles. Alternatively, the bottom end of the strut my be open, so that the strut can be lowered over a fixed spigot mounted on a horizontal surface.

BRIEF DESCRIPTION OF THE DRAWINGS

The invention will now be further described, by way of example, with reference to the accompanying drawings, in which:

FIG. 5 shows alternative foot plate and head plate configurations;

DETAILED DESCRIPTION

Figure 1:
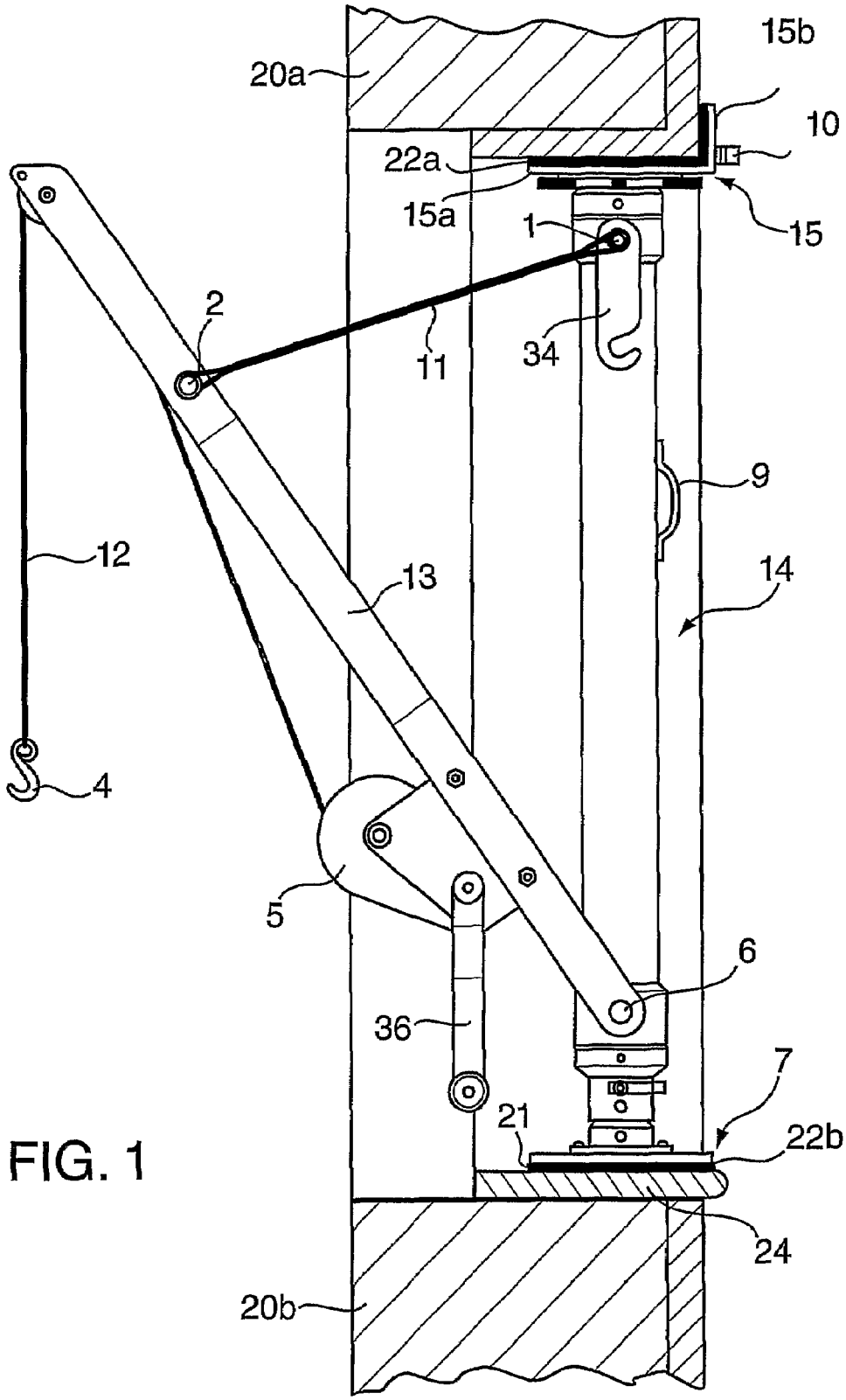
FIG. 1 shows a side view of a crane according to one embodiment of the invention.
Figure 1A:
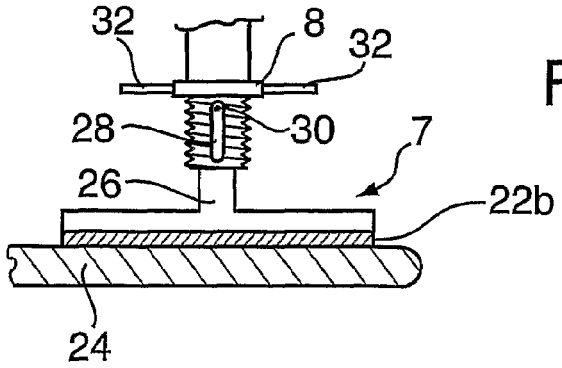
FIG. 1*a* shows a detail of part of the crane of FIG. 1.
Figure 2:
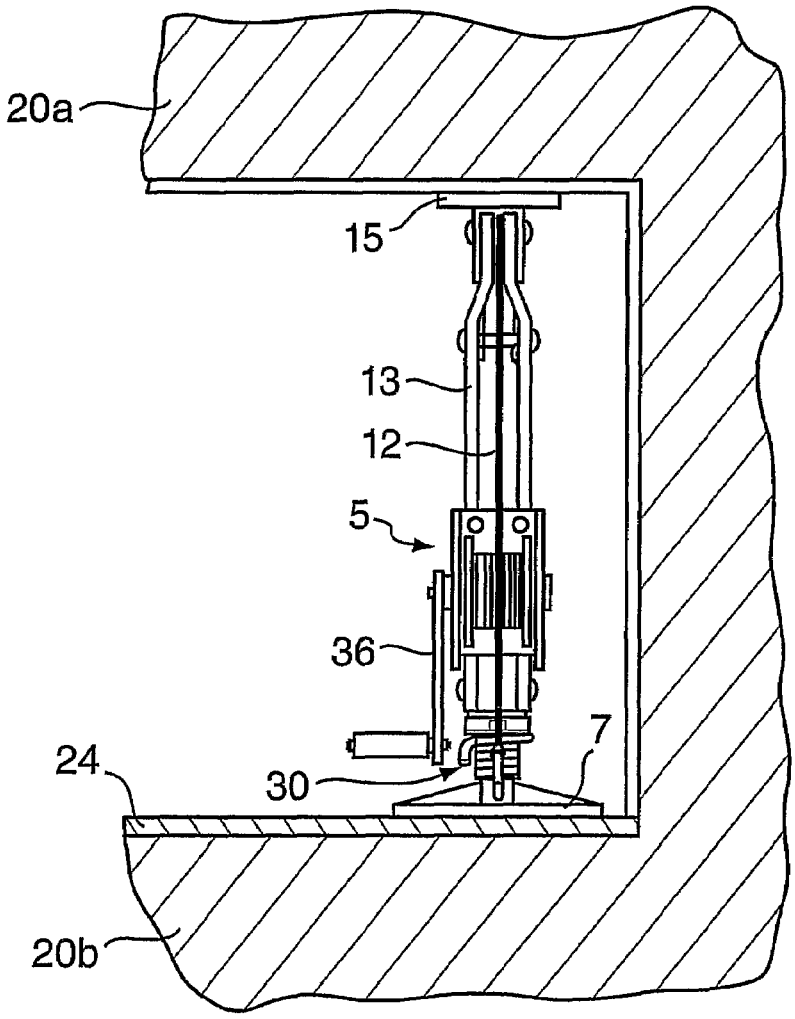
FIG. 2 shows a front view of the crane of FIG. 1.
Figure 3:
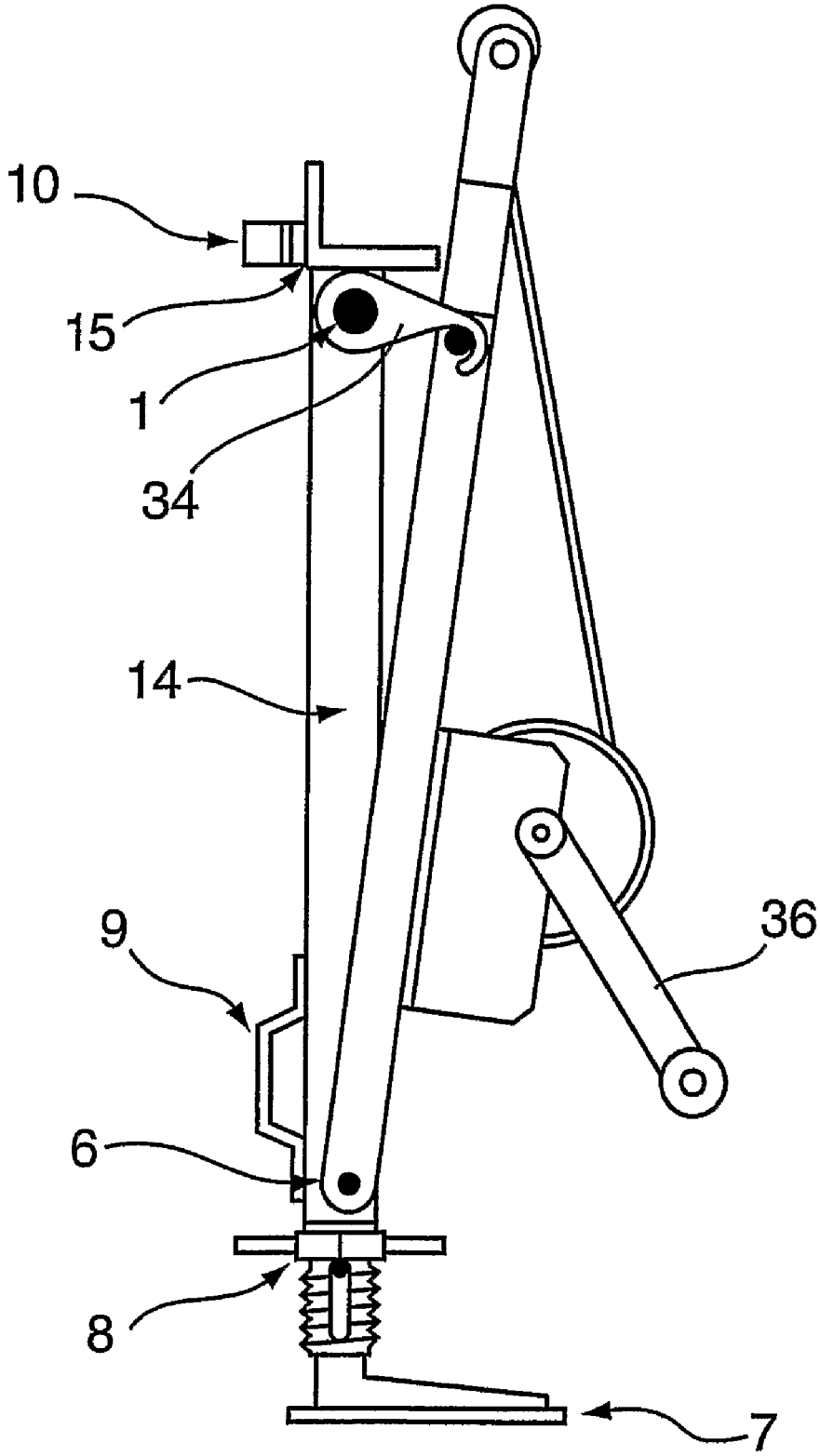
FIG. 3 shows a side view of the crane of FIG. 1 in its portable configuration.

The crane of FIGS. 1 to 3 has support means comprising an elongate strut 14, a head plate 15 and a foot plate 7. The crane is installed between two fixed surfaces provided by structures 20*a* and 20*b* shown in cross-section in FIG. 1. Structures 20*a* and 20*b* define a window opening in a building, for example.

Head plate 15 provides an engagement surface 22*a* in contact with structure 20*a*, and foot plate 7 provides an engagement surface 22*b* in contact with a window board 24 resting on structure 20*b*.

Head plate 15 comprises a planar portion 15*a* perpendicular to the longitudinal axis of the strut 14 and a portion 15*b* upstanding from portion 15*a*, which extends parallel to that axis. As shown in FIG. 1, head plate portion 15*b* is arranged to engage an internal vertical surface of the structure 20*a*.

The planar engagement surface 22*b* of foot plate 7 extends in a plane perpendicular to the longitudinal axis of strut 14. A slippage resistant cushioning material 21, such as rubber, is provided over the engagement surface of the foot plate 7 to assist secure installation of the crane. The foot plate has an elongate upstanding cylindrical member 26 or post which is slidably received in the tubular bore of the bottom end of the strut 14.

The outer surface of the strut is threaded over a portion near the bottom end of the strut (FIG. 1*b*). A slot 28 is formed in the threaded portion of the strut which has its longitudinal axis oriented parallel with the longitudinal axis of the strut and communicates with the opening in that end of the strut. A pin 30 extends outwardly from elongate member 26 and through the slot 28. A collar 8 has a thread tapped into its inner circumferential surface which is engaged with the threaded portion of the strut. The lower surface of the ring is in engagement with the pin 30. Radially extending spokes 32 are provided on the outer surface of the ring to assist manual rotation of it about the strut.

In use, rotation of ring 8 about the strut 14 in the appropriate direction exerts a force on the pin 8, urging the foot plate 7 away from head plate 15. This enables firm mounting of the crane between fixed structures 20*a* and 20*b*. This mechanism is essentially that of the well-known "Acrow" prop.

A boom 13 is pivotally attached to the strut 14 at a pivot 6. The pivot is near one end of the boom and adjacent to the threaded end of the strut 14, towards the foot plate 7. The boom is pivotable about pivot 6 between an extended position shown in FIG. 1 and a retracted position adjacent to the strut shown in FIG. 3. When the crane is in use, the boom is extended to the position shown in FIG. 1. It is held in that orientation by tension wires 11 which are attached between a point 2 near the distal end of the boom and a point 1 near the head plate end of the strut 14.

Means may be provided to adjust the length of the wires 11 to alter the angle of the boom 13 relative to the strut 14, such as a winch for example.

The strut is rotatable about its longitudinal axis relative to the foot and head plates, 7 and 15. Thrust bearings are provided in the strut/foot plate joint and at the strut/head plate joint to facilitates rotation of the boom 13 about this axis.

A hand operated winch 5 is mounted on the boom 13, having an elongate handle 36. A wire rope or cable 12 wound around the winch passes from the winch over a pulley 3 at the distal end of the boom 13 and has a hook 4 at its free end. The hook can be replaced by any appropriate fitting to connect to an object to be lifted.

The crane is readily transportable with the boom in the retracted position shown in FIG. 3. A hook 34 is provided on one or opposite sides of the strut towards the head plate end for releasable engagement with a respective pin or pins provided on the boom 13. Conveniently, the hook(s) may be mounted at the tension wires attachment point 1 on the strut, and the pins at the tension wires attachment point 2 on the boom. Handles 9 and 10 are provided on the strut 14 and head plate 15, respectively, to assist a user when carrying the crane and also during installation and removal of the crane 'on site'.

To install the crane in an opening as shown in FIG. 1, the foot plate 7 is positioned on the window board 24, and the head plate 15 is located below the upper fixed structure 22*a*. The ring 8 is then rotated so as to push the foot plate 7 away from the head plate, bringing the head plate into contact with the structure 22*a* with the upstanding portion 15*b* resting against the inner surface of the structure 20*a*. The ring 8 is rotated until the head plate is pressed firmly against the structure 22*a*, but excessive force does not need to be applied, for reasons which will now be described.

The boom is rotated around the longitudinal axis of the strut so that the cable 12 is suspended at a distance from the exterior of the building. The hook can then be lowered, and the winch used to raise the hook 4 once a load has been attached. The boom can be rotated again to bring the load horizontally towards the opening in which the crane is mounted.

The winch will have a conventional ratchet mechanism which can be engaged when lifting the load, to prevent the winch drum rotating in the opposite, unwinding, direction and disengaged when the cable has to be paid out.

As illustrated in FIGS. 1 and 2, the boom is held at an angle at which its distal end is lower than the upper engagement surface 22*a*. It can therefore be swung within the window opening during the installation process.

As shown in FIG. 1, the crane can be located adjacent the inner edge of an opening, spaced from the outer edge. This enables a window to be lifted up to the opening and installed with the crane in situ. Thus a window can be installed whilst still tethered to the crane, so that it will not fall to the ground if released accidentally before its installation is complete. One or more selectively securable suction cups may be attached to the free end of the wire rope 12 to facilitate attachment of a glazed window thereto. Similarly the crane may be used to lower to the ground a window being replaced.

Tilting of the crane when loaded is resisted by the slippage resistant material on the foot plate 7, and by the upstanding portion l5*b* of the head plate 15. Furthermore, the foot plate 7 extends away from the post 26, towards the window opening, such that if the strut were to tilt, it would pivot about the edge of the foot plate closest to the window opening (the post 26 will be rigid with the plate 7), and the result would be that the effective length of the strut between the fixed structures 20*a*, 20*b* would increase, holding it more firmly in place.

The weight of a load is transmitted to the boom 13 via the pulley 3. With foot plate 7 acting as a fulcrum, resulting force is in turn passed to the window opening via the tension wires 11, attachment point 1 and head plate 15. A vertical force exerted by the load is passed down the strut 14 to the foot plate 7. This force enhances the grip of the non-slip surface 22*b* of the foot plate 7 on the supporting surface, providing further resistance to inward movement of the foot plate.

The crane described herein can be configured to provide a substantial lifting capacity. An embodiment of the invention having a construction similar to that shown in the Figures has been found under test to have a lifting capability equivalent to four times that of two men (around 200 kg). The distance between the engagement surfaces of the crane during this test was 800 mm.

Preferably, in use, the crane is braced in the vertical orientation shown in FIGS. 1 and 2. Alternatively, a crane may be configured to be braced between engagement surfaces spaced apart in a horizontal or other direction. In a further variation, a crane may include two pairs of engagement surfaces, spaced apart in mutually perpendicular directions.

Although in the illustrated embodiment the engagement surfaces are urged apart using a screw thread arrangement near the foot plate, it will be appreciated that various other mechanisms may be used to achieve this. For example, a spring mechanism may be employed. Also the threaded configuration may instead be incorporated at another part of the support means, for example at the head plate end of the strut.

Figure 4:
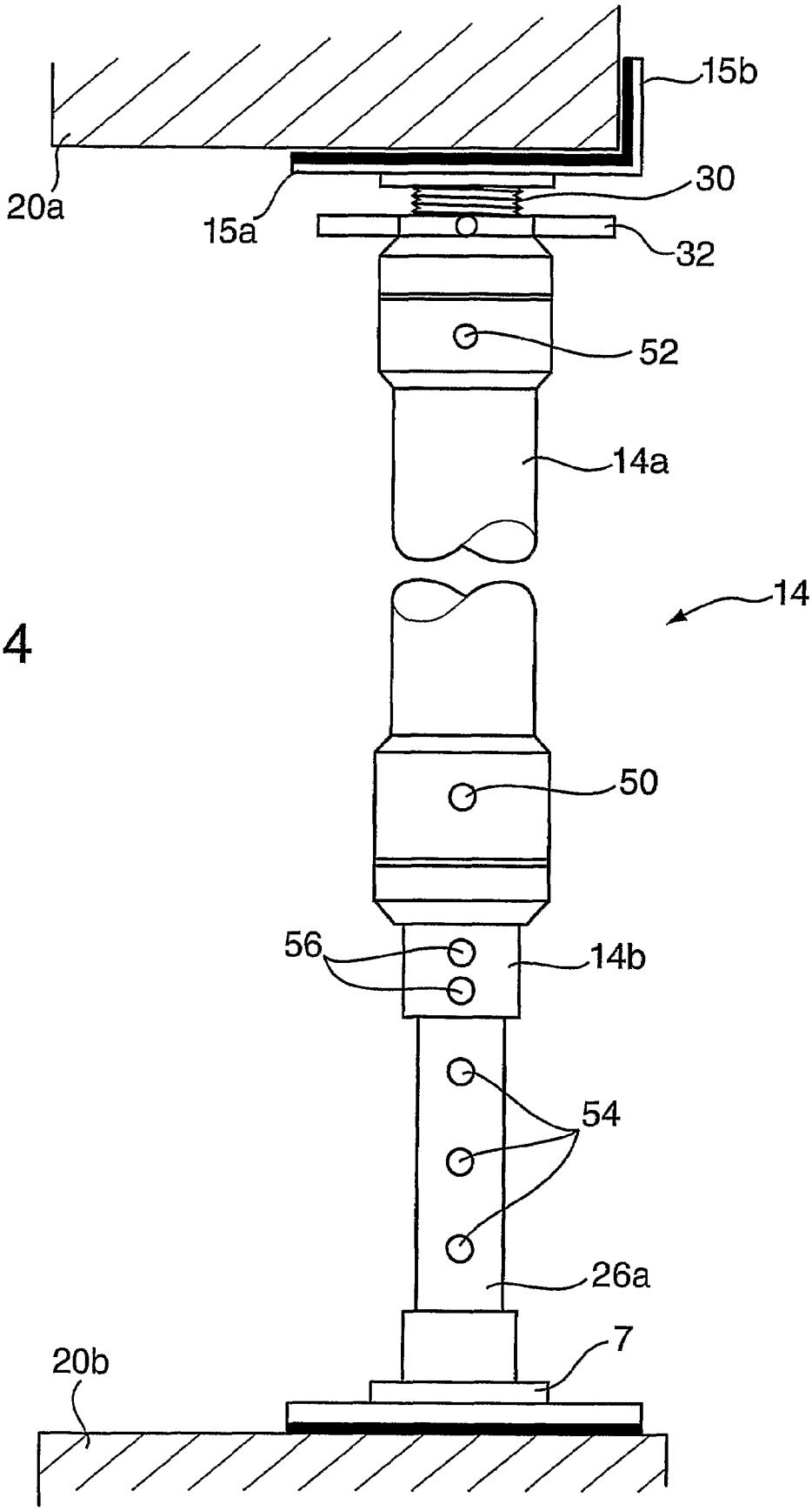
FIG. 4 shows a strut, with the boom not attached, illustrating possibilities for adjusting the length of the strut.

FIG. 4 shows an alternative construction of the strut 14. Here the strut has a main body 14*a*, with pivot axes at 50 for the boom 13 and at 52 for the hook 34. A long post 26*a* is mounted on the foot plate 7 and slides telescopically within the main body 14*a*. The post 26*a* has spaced holes 54, and a collar 14*b* at the bottom of the body 14*a* also has two spaced holes 56 (spacing different from that of the holes 54). Once the post 26*a* and the body 14*a* have been set to approximately the right length, a pin (not shown) is placed through one of the holes 56 and the nearest hole 54. The strut is then placed in the window opening and the threaded collar 32 is rotated to extend the threaded portion 30 until the strut is a tight fit between the structures 20*a* and 20*b*.

FIG. 5 shows alternative designs for the foot plate and head plate, for use where the window opening is stepped with an upper structure 70*a* and a lower structure 70*b*. The head plate 60 here has a vertical surface 60*b* and a horizontal surface 60*a*. The corner between these surface portions is cut away so as not to interfere with ceiling decoration, exemplified by the coving 62. The foot plate 64 has a downturned flange 64 to fit over an edge on the lower structure 70*b*.

Figure 6:
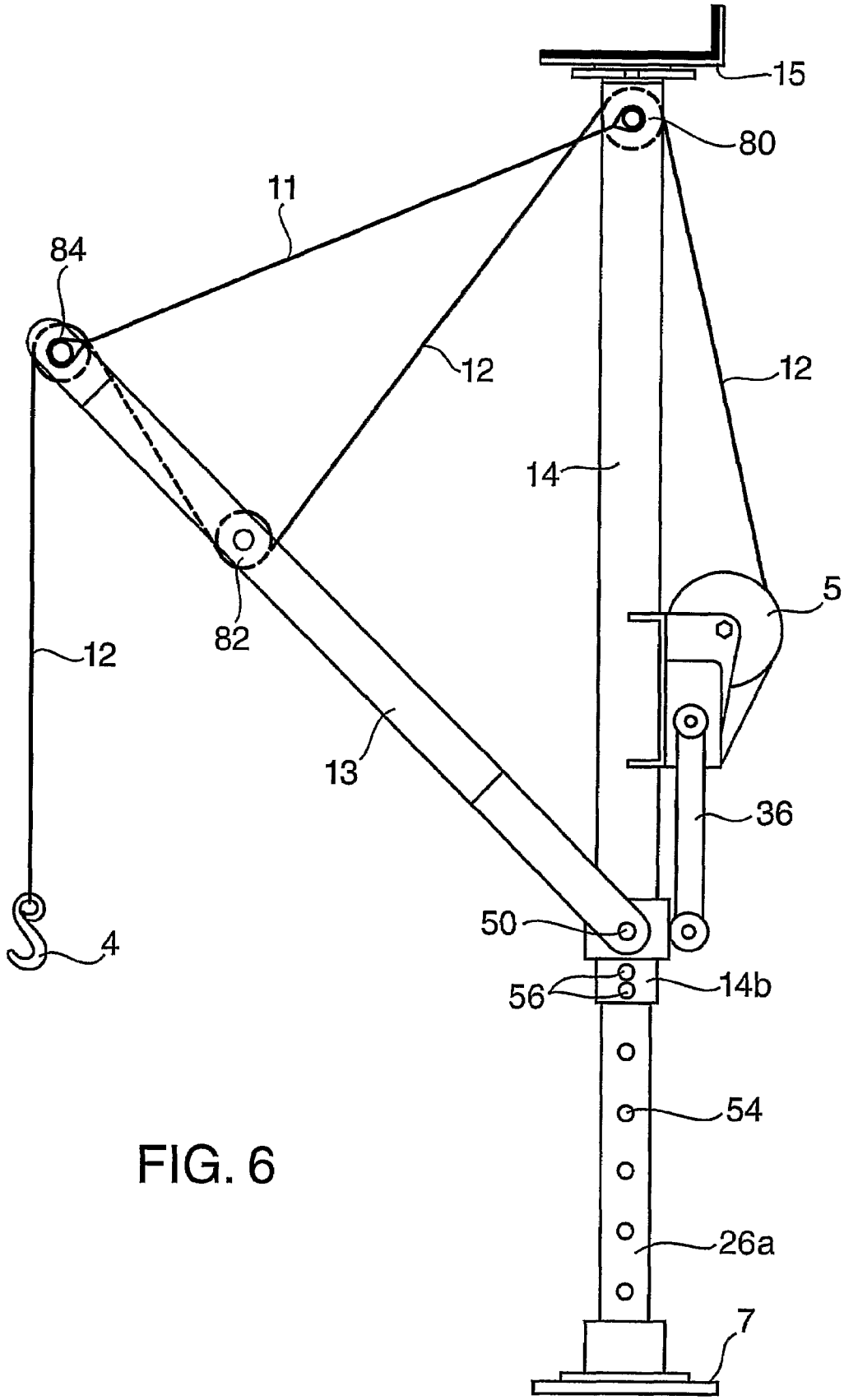
FIG. 6 shows a side view of a crane according to an alternative embodiment of the invention.
Figure 7:
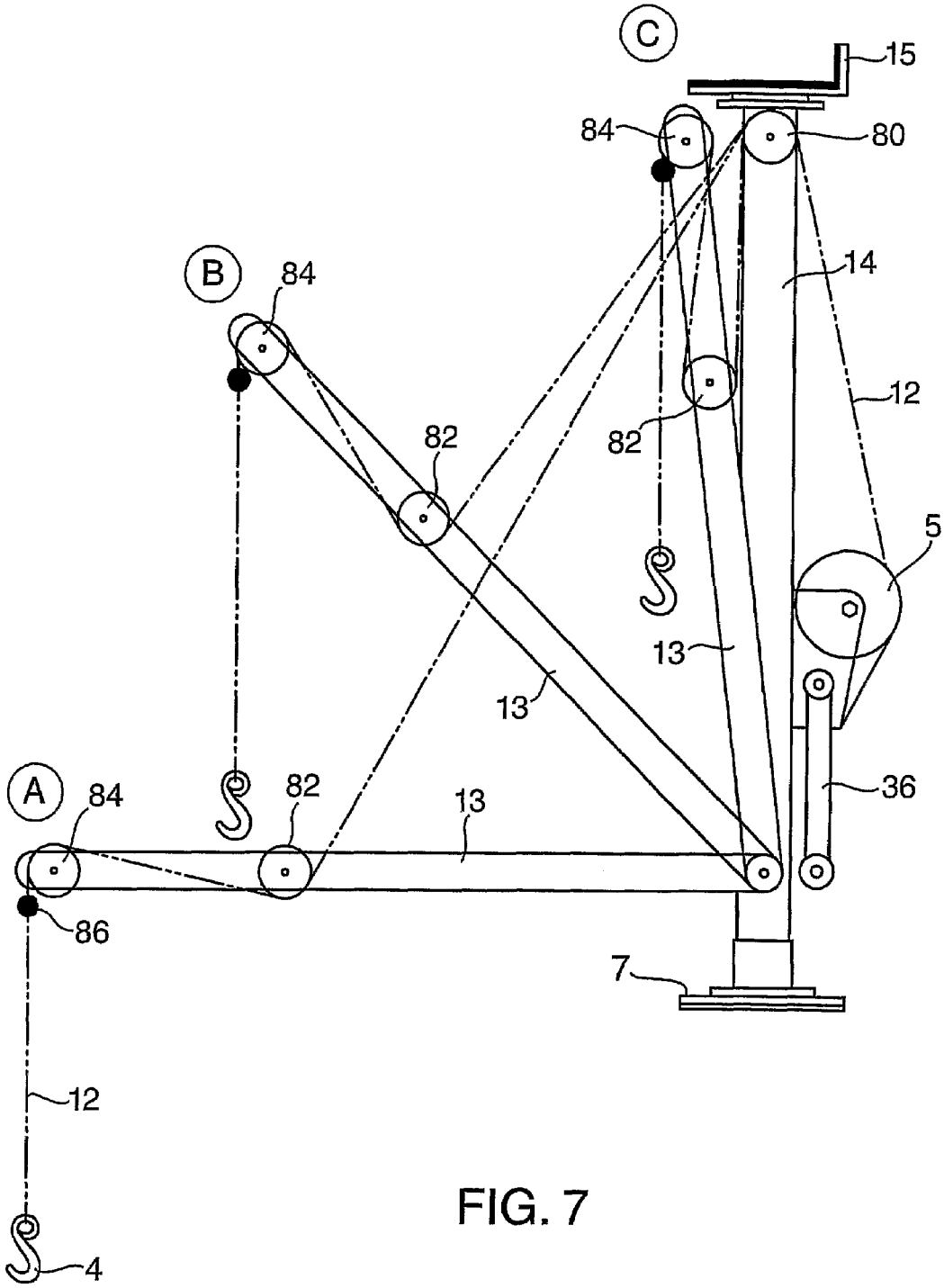
FIG. 7 illustrates the manner of operation of the crane of FIG. 6.

FIGS. 6 and 7 show another embodiment with similar parts identified by the same reference numerals. In this embodiment, when the load is hoisted right up to the end of the boom, and then hoisting continues, the boom is brought up towards the vertical so that the load is swung in, towards the position of the strut and thus into and through for example a window opening.

As can be seen from FIG. 6, the winch 5 is now mounted on the strut 14, and the cable 12 runs from the winch, over a pulley 80 at the top of the strut and then round two pulleys 82, 84 on the boom. Wires 11 are provided again to limit the downward movement of the boom in this view, but are omitted in FIG. 7.

FIG. 7 shows three different positions of the boom 13. In position A, the boom is at its lowest position (there will be suitable restraining equipment to stop it going any lower). The cable 12 as seen in this Figure is now shown with a stopper ball 86 a short distance above the hook 4. Once the stopper ball reaches the pulley 84, further winding up of the cable will bring the boom steadily upwards, through position B to position C, in which the load (hook 4) is practically in the window opening. Because the winch is mounted on the strut, winding up the cable 12 fully draws the boom up towards the strut.

This embodiment can be used to lift loads from and into the inside of a building by pivoting the boom through more than 90 degrees so that it extends inside the building. However in this position, the arrangement of head and foot plate will be less effective at maintaining the position of the strut between the top and bottom of the window opening, as the geometry of those components are designed to maintain the strut position when the load is suspended outside the building.

To avoid any possibility of the strut being dislodged from its normal position, when lifting or lowering loads inside the building, the crane will be provided with a latch similar to that shown at 34 in FIG. 1. When the boom is fully raised, the latch will be engaged and will remain engaged when loads are being lifted or lowered inside the building, so that the forces acting on the strut will be substantially all up and down, and will not try to tip the strut over, into the interior of the building.

Figure 8:
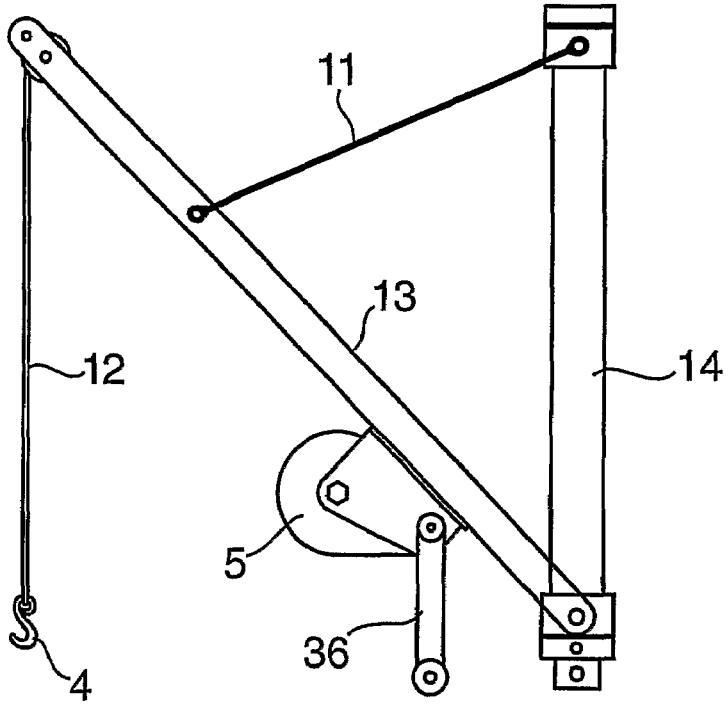
FIG. 8 shows a crane according to another embodiment.

The crane shown in FIG. 8 is essentially the same as that shown in FIG. 1, and similar parts are indicated by the same reference numerals. However this carne has no head and foot plates. Instead, to secure the crane to a surface 100, the strut 14 is hollow and open at the bottom, and the crane can be dropped over a rigidly mounted spigot 102 (FIG. 9), riveted to the surface 100.

Instead of a permanently upstanding spigot 102, FIG. 109 shows an arrangement where a spigot 102*a* is removably fitted in a rigidly mounted socket 104. This avoids the presence of the obstruction caused by the spigot 102, when the crane is not in use.

Figure 9:
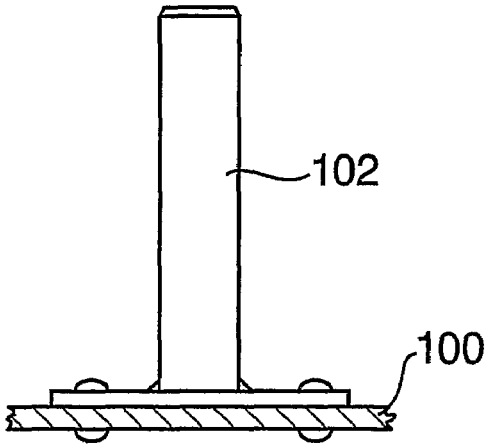
FIGS. 9 and 10 show two different spigot arrangements by which the crane of FIG. 8 can be mounted on a surface.
Figure 10:
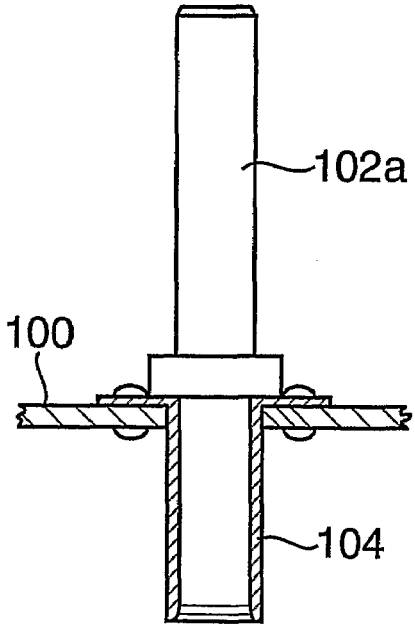

It should be noted that FIGS. 9 and 10 are drawn to a different scale from FIG. 8; in practice, the diameter of the spigot 102, 102*a* will be such that it can be inserted into the hollow bore of the strut 14.

Figure 11:
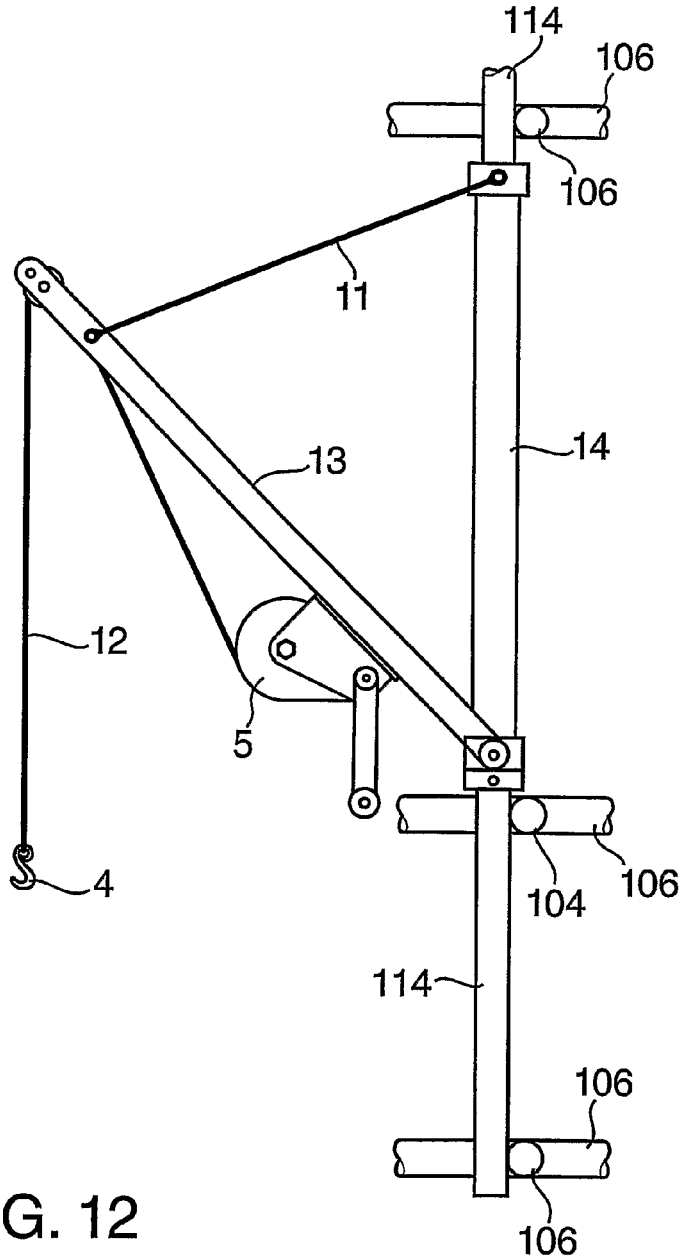
FIG. 11 shows a crane according to a still further embodiment of the invention.

FIG. 11 shows an embodiment where the strut 14 has upper and lower extensions 114 so that the crane can be attached to a scaffolding framework. Horizontal scaffold framework members are indicated at 106, and the crane is preferably attached to these scaffold members at places where two members cross one another. The strut extensions 114 can be made from scaffold pole themselves, and then conventional scaffold clamps can be used to mount the crane on a scaffold structure.

Figure 12:
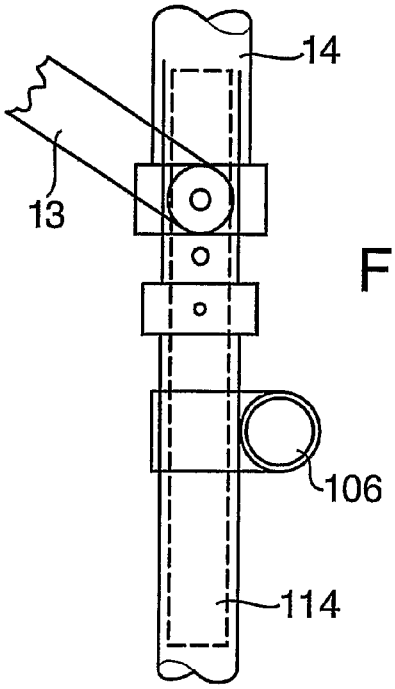
FIG. 12 shows a detail of the mounting method of the came of FIG. 11.

The crane described here is highly portable. It can be quickly and easily mounted either in an opening (FIGS. 1 to 7), on a surface (FIGS. 8 to 10), or on a scaffold structure (FIGS. 11 and 12), or to any other available rigid mounting structure. The crane can therefore be easily moved around from place to place. It can be lightweight enough to be carried comfortably by one man and requires no special tools for its mounting in place, or its operation.

It will also be appreciated that the crane described herein may be used to suspend and/or raise and lower equipment other than a window from a building, for example a work platform.

The invention claimed is:

1. A crane for installing a window in a window opening in a building, comprising:

a strut;

a head plate at one end of the strut;

a foot plate at the other end of the strut;

the strut being extendable to press the head and toe plates against opposing top and bottom surfaces of the opening;

a boom, pivoted at one end to the strut;

a winch, mounted on the strut, around which a hoisting cable can be wound, the hoisting cable extending from the winch, over a first pulley at an upper region of the strut, over a second pulley mounted on the boom between the strut and the distal end of the boom, over a third pulley at the distal end of the boom and to a load engagement point, such that when a load is fully hoisted to the distal end of the boom, further winding of the winch draws the boom towards the strut so that the window can be located in its final position without removing the crane from the window opening.

2. The crane of claim 1 further comprising a stopper ball mounted on the cable a short distance above the load engagement point such that when the stopper ball reaches the pulley at the distal end of the boom, further winding of the winch draws the boom towards the strut.

3. The crane of claim 1 further comprising a latch to hold the boom substantially parallel with the strut.

4. The crane of claim 1 further wherein the boom can pivot about an axis of the strut through at least 90 degrees.

5. The crane of claim 1 wherein the foot plate has a toe edge extending rigidly at right angles to the axis of the strut.

6. The crane of claim 1 wherein the boom is held at an angle to the strut by a flexible linkage between a distal end of the boom and an upper region of the strut.

7. The crane of claim 1 wherein the head plate has two faces, substantially at right angles to one another for engagement with two surfaces of an edge of the opening in which the crane is to be used.

* * * * *